US011401737B2

(12) United States Patent
Wang

(10) Patent No.: US 11,401,737 B2
(45) Date of Patent: Aug. 2, 2022

(54) SQUARE COMPUTER LOCK

(71) Applicant: XIAMEN MAKE SECURITY TECHNOLOGY CO., LTD., Fujian (CN)

(72) Inventor: Zhiqiang Wang, Xiamen (CN)

(73) Assignee: XIAMEN MAKE SECURITY TECHNOLOGY CO., LTD., Fujian (CN)

( * ) Notice: Subject to any disclaimer, the term of this patent is extended or adjusted under 35 U.S.C. 154(b) by 260 days.

(21) Appl. No.: 16/957,382

(22) PCT Filed: Feb. 6, 2018

(86) PCT No.: PCT/CN2018/075352

§ 371 (c)(1),
(2) Date: Jun. 24, 2020

(87) PCT Pub. No.: WO2019/153105

PCT Pub. Date: Aug. 15, 2019

(65) Prior Publication Data

US 2020/0332567 A1 Oct. 22, 2020

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
None
See application file for complete search history.

(56) References Cited

U.S. PATENT DOCUMENTS 5,791,171 A * 8/1998 Kelley ..... E05B 67/36 70/57
6,038,891 A * 3/2000 Zeren ..... E05B 73/0005 70/58
6,918,272 B1 * 7/2005 Sanders ..... E05B 73/0005 70/58
7,234,326 B1 * 6/2007 Lu ..... E05B 73/0082 70/57
7,302,816 B1 * 12/2007 Lu ..... E05B 73/0082 70/49
7,353,672 B2 * 4/2008 Lu ..... E05B 73/0005 70/57
7,401,481 B1 * 7/2008 Lin ..... E05B 73/0005 70/58

(Continued)

*Primary Examiner* — Xanthia C Cunningham
(74) *Attorney, Agent, or Firm* — Leong C. Lei

(57) ABSTRACT

A square computer lock includes a square housing, and a lock core, a lock tongue, an unlocking button, a locking button and a latch arranged in the square housing. An insertion hole is formed on the rear side of the square housing. A row of plate tumblers are arranged in a lock core lock hole. A plate tumbler spring is arranged below each plate tumbler. Positioning posts are formed on a lateral surface of the latch. A wedge-shaped plate is formed at a lower end of the unlocking button. An unlocking spring is arranged between the wedge-shaped plate and the bottom of the square housing. The locking button is arranged in the square housing in a front-back movable manner. An upper end of the locking button penetrates in a locking hole in a front-back movable manner.

7 Claims, 5 Drawing Sheets

(56) References Cited

U.S. PATENT DOCUMENTS

| | | | | |
|---|---|---|---|---|
| 2008/0034816 | A1* | 2/2008 | Lu | E05B 73/0082 70/58 |
| 2010/0180648 | A1* | 7/2010 | Knox | E05B 73/0082 70/58 |
| 2012/0227448 | A1* | 9/2012 | Su | E05B 73/0005 70/58 |

* cited by examiner

SQUARE COMPUTER LOCK

BACKGROUND OF THE INVENTION

1. Field of the Invention

The present invention relates to a lock, and more particularly to a square computer lock.

2. Description of the Prior Art

Most computer locks on the market are cylindrical and large in size. With the development of technology, notebook computers are becoming thinner and thinner, and the cylindrical computer locks are not flexible enough due to their large size, and they cannot meet market demands.

In view of this, the inventor of the present invention has devoted himself based on his many years of practical experiences to solve these problems and to develop a compact and flexible computer lock.

SUMMARY OF THE INVENTION

The primary object of the present invention is to provide a square computer lock, which has a simple structure and is compact and is flexible for use.

In order to achieve the above object, the present invention adopts the following technical solutions:

A square computer lock comprises a square housing, and a lock core, a lock tongue, an unlocking button, a locking button and a latch arranged in the square housing.

A front side of the square housing is formed with a hole. The lock tongue is composed of an upper lock plate and a lower lock plate. The upper lock plate and the lower lock plate are symmetrical and arranged one on top of another. A middle portion of the upper lock plate and a middle portion of the lower lock plate are pivotally connected to the hole through fixing pins, respectively. Front ends of the upper lock plate and the lower lock plate extend out of the hole. A rear end of the upper lock plate is inclined upward to form an upper inclined portion. A rear end of the lower lock plate is inclined downward to form a lower inclined portion. A rotation space is defined between the upper inclined portion and the lower inclined portion. A torsion spring is provided in the rotation space.

A rear side of the square housing is formed with an insertion hole allowing a key to be inserted and corresponding in position to a lock core lock hole. A row of plate tumblers are arranged in the lock core lock hole. A plate tumbler spring is arranged below each of the plate tumblers. The plate tumblers cooperate with key bits of the key inserted into the lock core lock hole when unlocked and are pushed down by the key bits to press down the plate tumbler springs. The plate tumblers are moved upward and returned by the plate tumbler springs when locked. One side of each plate tumbler is formed with a positioning groove. One side of the lock core is formed with an engaging groove. A bottom of the engaging groove is provided with a row of positioning holes corresponding to the positioning grooves of the plate tumblers. The positioning grooves are aligned with the positioning holes when the plate tumblers are pushed down by the key. The latch is disposed in the engaging groove. One side of the latch is provided with a row of positioning posts corresponding in position to the positioning holes. Each of the positioning posts is sleeved with a latch spring. One end of the latch spring abuts against a periphery of a corresponding one of the positioning holes.

A top of the square housing is formed with an unlocking hole and a locking hole. An upper end of the unlocking button is movably inserted through the unlocking hole to be moved up and down. A lower end of the unlocking button is formed with a wedge-shaped plate corresponding to the latch. An unlocking spring is arranged between the wedge-shaped plate and a bottom of the square housing. A front side of the wedge-shaped plate is formed with a limiting groove. The locking button is movably disposed in the square housing to be moved frontward and backward. An upper end of the locking button is inserted through the locking hole to be moved frontward and backward. A rear side of the locking button is formed with a limiting plate corresponding to the limiting groove. A front side of the locking button is formed with an inclined groove corresponding to the upper inclined portion and the lower inclined portion. The inclined groove has an inclined upper wall and an inclined lower wall. An upper edge of the upper inclined portion and a lower edge of the lower inclined portion abut against the upper wall and the lower wall, respectively. A locking spring is provided between the front side of the locking button and the square housing.

The unlocking button is moved downward by an external force to compress the unlocking spring when unlocking, and the wedge-shaped plate pushes the latch into the engaging groove, so that the positioning posts of the latch are inserted into the positioning holes and the positioning grooves. The limiting groove is aligned with the limiting plate of the locking button. The locking button is moved backward by the locking spring so that the limiting plate is inserted into the limiting groove to be positioned therein. The upper inclined portion and the lower inclined portion of the lock tongue are moved outward along the upper wall and the lower wall of the inclined groove, so that the upper lock plate and the lower lock plate are rotated towards each other by the torsion spring until the front end of the upper lock plate and the front end of the lower lock plate are closed.

The upper end of the locking button is pushed forward by an external force when locking, so that the limiting plate is disengaged from the limiting groove and presses against the front side of the wedge-shaped plate to release the positioning of the unlocking button and compress the locking spring. The unlocking button is moved upward and returned by the unlocking spring. The latch is moved outward and returned from the positioning grooves and the positioning holes by the latch springs on the positioning posts. After the key is pulled out, the plate tumblers are moved upward and returned by the plate tumbler springs. The upper inclined portion and the lower inclined portion of the lock tongue are moved into the inclined groove along the upper wall and the lower wall respectively, so that the upper lock plate and the lower lock plate are pushed by the upper wall and the lower wall to rotate reversely, and the front end of the upper lock plate and the front end of the lower lock plate are separated by a predetermined distance.

Furthermore, the square computer lock further comprises a cable and a cable connector. The cable connector includes a first connector and a second connector. A front end of the first connector is formed with a notch. The bottom of the square housing is formed with a connecting hole. A bottom of the lock core is formed with a connecting plate. The connecting plate is inserted into the notch after passing through the connecting hole and is pivotally connected to the first connector by means of a rotation of 180° through a pivot. The second connector is connected to the first connector by means of a rotation of 360°. The cable is connected to the second connector.

Furthermore, the square housing is composed of a seat and a cover plate. The cover plate covers one side of the seat. The hole is formed on a front side of the seat. The unlocking hole and the locking hole are formed on a top of the seat. The insertion hole is formed on a rear side of the seat.

Furthermore, the upper end of the unlocking button is formed with a cylindrical press portion. The upper end of the locking button is formed with a push portion. The push portion has a curved push surface on which anti-skid ribs are formed.

Furthermore, a rubber pad is attached to the front side of the locking button. The rubber pad has a through hole corresponding to the inclined groove.

Furthermore, the limiting groove is a square groove.

Furthermore, the lock core is fixedly installed in the square housing through the fixing pins.

With the above solutions, when the lock of the present invention is to be locked, the lock is first in an unlocked state, that is, the front end of the lock tongue is in a closed state. The front end of the lock tongue is inserted into a lock hole of a computer, and the upper end of the locking button is pushed by hand, so that the locking button is pushed forward by the external force. The limiting plate is disengaged from the limiting groove and presses against the front side of the wedge-shaped plate to release the positioning of the unlocking button, and the front side of the locking button pushes and compresses the locking spring. The unlocking button is moved upward and returned by the unlocking spring. The latch is moved outward and returned from the positioning grooves and the positioning holes by the latch springs on the positioning posts. After the key is pulled out, the plate tumblers are moved upward and returned by the plate tumbler springs. The upper inclined portion and the lower inclined portion of the lock tongue are moved into the inclined groove along the upper wall and the lower wall, respectively, so that the upper lock plate and the lower lock plate are pushed by the upper wall and the lower wall to rotate reversely, and the front end of the upper lock plate and the front end of the lower lock plate are separated by a predetermined distance. Therefore, the front end of the lock tongue is opened and cannot be pulled out from the lock hole of the computer to achieve locking.

When the lock of the present invention is to be unlocked, the key is first inserted. The plate tumblers cooperate with the key bits of the key inserted into the lock core lock hole, and are pushed down by the key bits to press down the plate tumbler springs. Then, the press portion of the unlocking button is pressed by hand to move downward under the external force, and the unlocking button compresses the unlocking spring. The wedge-shaped plate at the lower end of the unlocking button pushes the latch into the engaging groove, so that the positioning posts of the latch are inserted into the positioning holes and the positioning grooves, and the latch is moved into the lock core. The limiting groove at the front side of the wedge-shaped plate is aligned with the limiting plate at the rear side of the locking button. The locking button is moved backward by the locking spring until the limiting plate is inserted into the limiting groove to be positioned therein. The upper inclined portion and the lower inclined portion of the lock tongue are moved outward along the upper wall and the lower wall of the inclined groove, so that the upper lock plate and the lower lock plate are rotated towards each other by the torsion spring until the front end of the upper lock plate and the front end of the lower lock plate are closed. Therefore, the front end of the closed lock tongue can be pulled out from the lock hole of the computer to realize unlocking.

The beneficial effects of the present invention are described below. The lock is locked by pushing the locking button. The lock is unlocked by inserting a key and pressing the unlocking button. There is no need to rotate the lock core for unlocking the lock. The lock adopts a square housing structure, which has a thinner lock body and is small in size and is simple and flexible for use compared with conventional computer locks.

Embodiments of the present invention will now be described, by way of example only, with reference to the accompanying drawings.

DETAILED DESCRIPTION OF THE PREFERRED EMBODIMENTS

Figure 1:
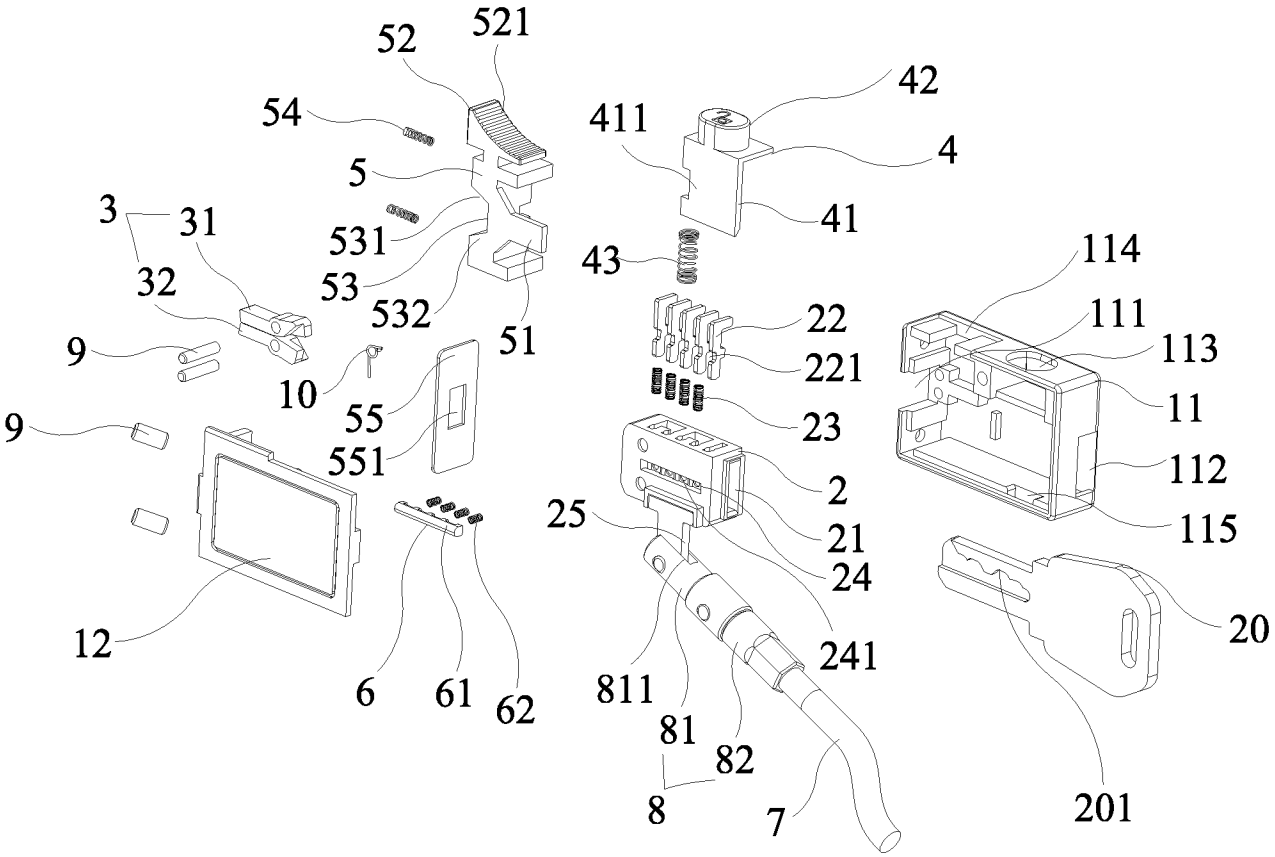
FIG. 1 is an exploded view of the present invention.

As shown in FIG. 1, the present invention discloses a square computer lock, comprising a square housing 1, and a lock core 2, a lock tongue 3, an unlocking button 4, a locking button 5 and a latch 6 arranged in the square housing 1.

The square housing 1 is composed of a seat 11 and a cover plate 12. The cover plate 12 covers one side of the seat 11. A hole 111 is formed on a front side of the seat 11. The lock tongue 3 is composed of an upper lock plate 31 and a lower lock plate 32. The upper lock plate 31 and the lower lock plate 32 are symmetrical and arranged one on top of another. A middle portion of the upper lock plate 31 and a middle portion of the lower lock plate 32 are pivotally connected to the hole 111 through fixing pins 9, respectively. Front ends of the upper lock plate 31 and the lower lock plate 32 extend out of the hole 111. A rear end of the upper lock plate 31 is inclined upward to form an upper inclined portion 311. A rear end of the lower lock plate 32 is inclined downward to form a lower inclined portion 321. A rotation space is defined between the upper inclined portion 311 and the lower inclined portion 312. A torsion spring 10 is provided in the rotation space.

The lock core 2 is fixedly installed in the square housing 1 through the fixing pins 9. A rear side of the seat 11 of the square housing 1 is formed with an insertion hole 112 allowing a key 20 to be inserted and corresponding in position to a lock core lock hole 21. A row of plate tumblers 22 are arranged in the lock core lock hole 21. A plate tumbler spring 23 is arranged below each plate tumbler 22. The plate tumblers 22 cooperate with key bits 201 of the key 20 inserted into the lock core lock hole 21 when unlocked, and are pushed down by the key bits 201 to press down the plate tumbler springs 23. The plate tumblers 22 are moved upward and returned by the returning force of the plate tumbler springs 23 when locked. One side of each plate tumbler 22 is formed with a positioning groove 221. One side of the lock core 2 is formed with an engaging groove 24. The bottom of the engaging groove 24 is provided with a row of positioning holes 241 corresponding to the positioning grooves 221 of the plate tumblers 22. When the plate tumblers 22 are pushed down by the key 20, the positioning grooves 221 are aligned with the positioning holes 241. The latch 6 is disposed in the engaging groove 24. One side of the latch 6 is provided with a row of positioning posts 61 corresponding in position to the positioning holes 241. Each of the positioning posts 61 is sleeved with a latch spring 62. One end of the latch spring 62 abuts against the periphery of the positioning hole 241. The top of the seat 11 of the square housing 1 is formed with an unlocking hole 113 and a locking hole 114. An upper end of the unlocking button 4 is movably inserted through the unlocking hole 113 to be moved up and down. A lower end of the unlocking button 4 is formed with a wedge-shaped plate 41 corresponding to the latch 6. An unlocking spring 43 is arranged between the wedge-shaped plate 41 and the bottom of the square housing 1. A front side of the wedge-shaped plate 41 is formed with a limiting groove 411. Preferably, the limiting groove 411 is a square groove. The locking button 5 is movably disposed in the square housing 1 to be moved frontward and backward. An upper end of the locking button 5 is inserted through the locking hole 114 to be moved frontward and backward. A rear side of the locking button 5 is formed with a limiting plate 51 corresponding to the limiting groove 411. A front side of the locking button 5 is formed with an inclined groove 53 corresponding to the upper inclined portion 311 and the lower inclined portion 321. The inclined groove 53 has an inclined upper wall 531 and an inclined lower wall 532. An upper edge of the upper inclined portion 311 and a lower edge of the lower inclined portion 321 abut against the upper wall 531 and the lower wall 532, respectively. A locking spring 54 is provided between the front side of the locking button 5 and the square housing 1.

The unlocking button 4 is moved downward by an external force to compress the unlocking spring 43 when unlocking, and the wedge-shaped plate 41 pushes the latch 6 into the engaging groove 24, so that the positioning posts 61 of the latch 6 are inserted into the positioning holes 241 and the positioning grooves 221. The limiting groove 411 is aligned with the limiting plate 51 of the locking button 5. The locking button 5 is moved backward by the locking spring 54 so that the limiting plate 51 is inserted into the limiting groove 411 to be positioned therein. The upper inclined portion 311 and the lower inclined portion 321 of the lock tongue 3 are moved outward along the upper wall 531 and the lower wall 532 of the inclined groove 53, so that the upper lock plate 31 and the lower lock plate 32 are rotated towards each other by the torsion spring 10 until the front end of the upper lock plate 31 and the front end of the lower lock plate 32 are closed.

The upper end of the locking button 5 is pushed forward by an external force when locking, so that the limiting plate 51 is disengaged from the limiting groove 411 and presses against the front side of the wedge-shaped plate 41 to release the positioning of the unlocking button 4 and compress the locking spring 54. The unlocking button 4 is moved upward and returned by the unlocking spring 43. The latch 6 is moved outward and returned from the positioning grooves 221 and the positioning holes 241 by the latch springs 62 on the positioning posts 61. After the key 20 is pulled out, the plate tumblers 22 are moved upward and returned by the plate tumbler springs 23. The upper inclined portion 311 and the lower inclined portion 321 of the lock tongue 3 are moved into the inclined groove 53 along the upper wall 531 and the lower wall 532, respectively, so that the upper lock plate 31 and the lower lock plate 32 are pushed by the upper wall 531 and the lower wall 532 to rotate reversely, and the front end of the upper lock plate 31 and the front end of the lower lock plate 32 are separated by a predetermined distance.

In a preferred embodiment, the square computer lock further includes a cable 7 and a cable connector 8. The cable connector 8 includes a first connector 81 and a second connector 82. A front end of the first connector 81 is formed with a notch 811. The bottom of the seat 11 of the square housing 1 is formed with a connecting hole 115. The bottom of the lock core 2 is formed with a connecting plate 25. The connecting plate 25 is inserted into the notch 811 after passing through the connecting hole 115, and is pivotally connected to the first connector 81 by means of a rotation of 180° through a pivot. The second connector 82 is connected to the first connector 81 by means of a rotation of 360°. The cable 7 is connected to the second connector 82. Therefore, the cable 7 of the present invention can be flexibly rotated at different angles, which is convenient for flexible installation.

In a preferred embodiment, the upper end of the unlocking button 4 is formed with a cylindrical press portion 42, and the upper end of the locking button 5 is formed with a push portion 52. The push portion 52 has a curved push surface 521 on which anti-skid ribs are formed.

In order to provide more cushioning for the locking button 5 to move frontward and backward, a rubber pad 55 is attached to the front side of the locking button 5. The rubber pad 55 has a through hole 551 corresponding to the inclined groove 53.

Figure 2:
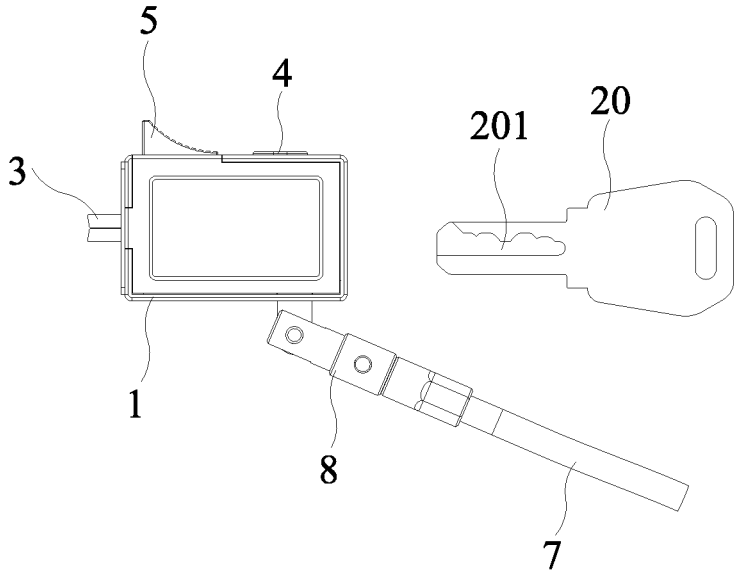
FIG. 2 is a side view of the present invention in an unlocked state.
Figure 3:
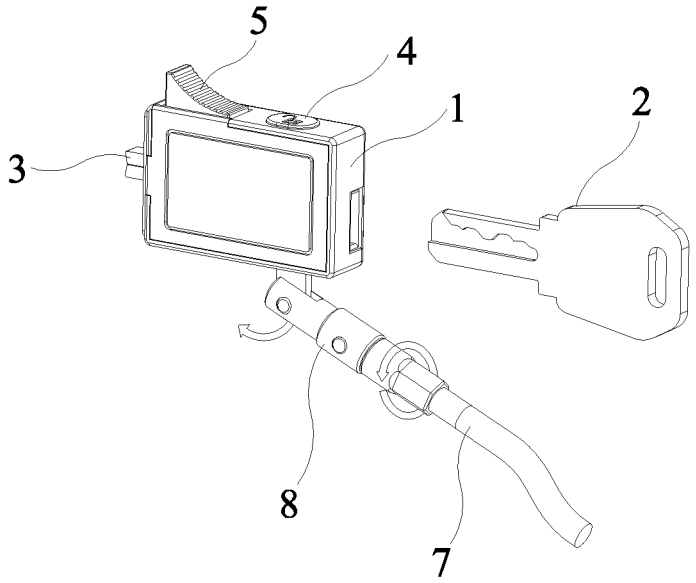
FIG. 3 is a perspective view of the present invention in an unlocked state.
Figure 4:
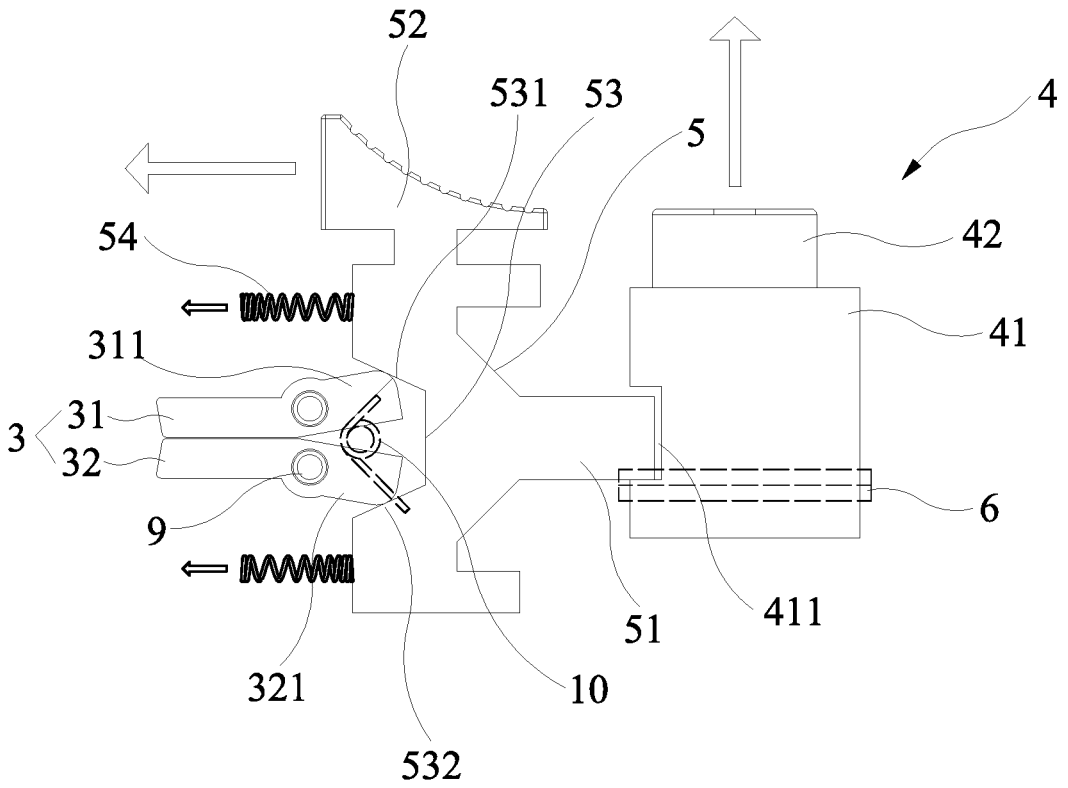
FIG. 4 is a schematic view showing the internal structure of the present invention in an unlocked state.

When the lock of the present invention is to be locked, as shown in FIGS. 2-4, the lock is first in an unlocked state, that is, the front ends of the upper lock plate 31 and the lower lock plate 32 of the lock tongue 3 are in a closed state. The front end of the lock tongue 3 is inserted into a lock hole of a computer, and the upper end of the locking button 5 is pushed by hand, so that the locking button 5 is pushed forward by the external force. The limiting plate 51 is disengaged from the limiting groove 411 and presses against the front side of the wedge-shaped plate 41 to release the positioning of the unlocking button 4, and the front side of the locking button 5 pushes and compresses the locking spring 54. The unlocking button 4 is moved upward and returned by the unlocking spring 43. The latch 6 is moved outward and returned from the positioning grooves 221 and the positioning holes 241 by the latch springs 62 on the positioning posts 61. After the key 20 is pulled out, the plate tumblers 22 are moved upward and returned by the plate tumbler springs 23. The upper inclined portion 311 and the lower inclined portion 321 of the lock tongue 3 are moved into the inclined groove 53 along the upper wall 531 and the lower wall 532, respectively, so that the upper lock plate 31 and the lower lock plate 32 are pushed by the upper wall 531 and the lower wall 532 to rotate reversely, and the front end of the upper lock plate 31 and the front end of the lower lock plate 32 are separated by a predetermined distance. Therefore, the front end of the lock tongue 3 is opened and cannot be pulled out from the lock hole of the computer to achieve locking.

Figure 5:
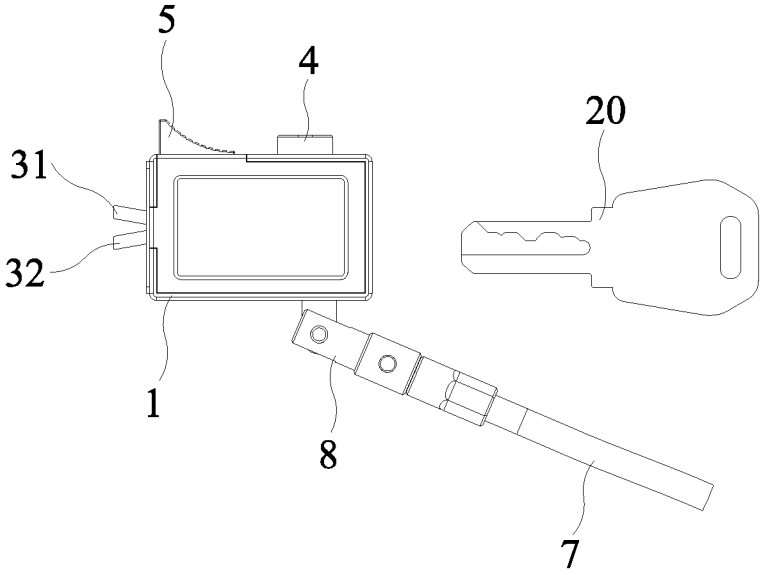
FIG. 5 is a side view of the present invention in a locked state.
Figure 6:
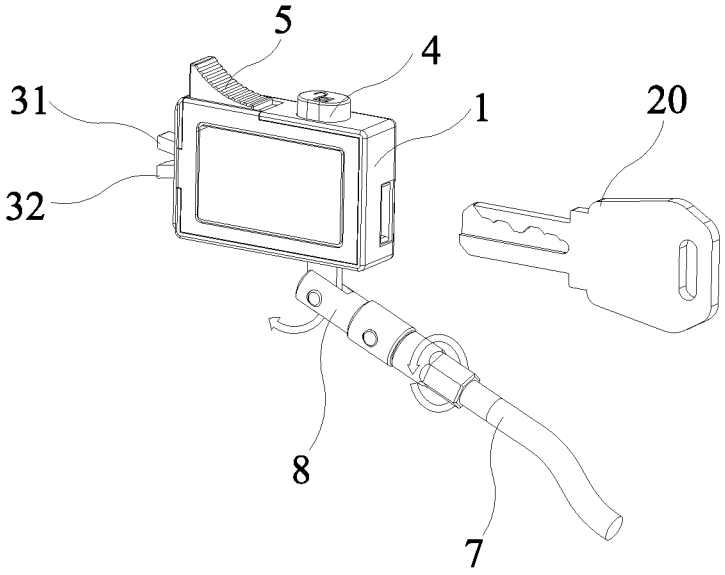
FIG. 6 is a perspective view of the present invention in a locked state.
Figure 7:
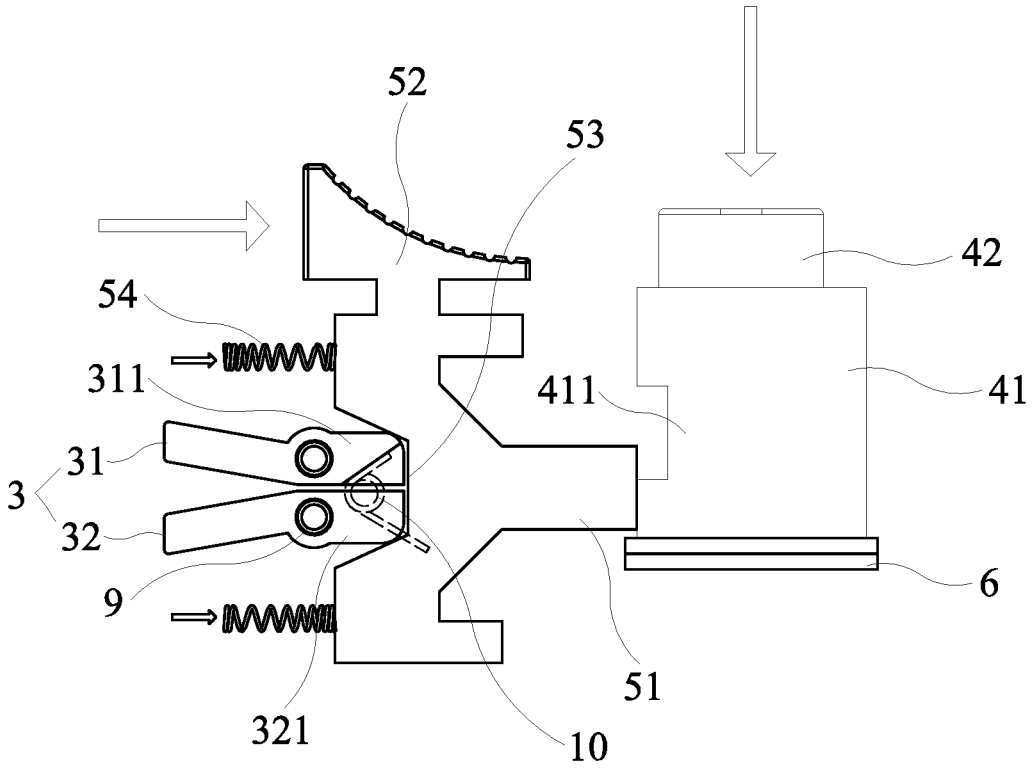
FIG. 7 is a schematic view showing the internal structure of the present invention in a locked state.

When the lock of the present invention is to be unlocked, as shown in FIGS. 5-7, the lock is in a locked state, and the key 20 is first inserted. The plate tumblers 22 cooperate with the key bits 201 of the key 20 inserted into the lock core lock hole 21, and are pushed down by the key bits 201 to press down the plate tumbler springs 23. Then, the press portion 42 of the unlocking button 4 is pressed by hand to move downward under the external force, and the unlocking button 4 compresses the unlocking spring 43. The wedge-shaped plate 41 at the lower end of the unlocking button 4 pushes the latch 6 into the engaging groove 24, so that the positioning posts 61 of the latch 6 are inserted into the positioning holes 241 and the positioning grooves 221, and the latch 6 is moved into the lock core 2. The limiting groove 411 at the front side of the wedge-shaped plate 41 is aligned with the limiting plate 51 at the rear side of the locking button 5. The locking button 5 is moved backward by the locking spring 54 until the limiting plate 51 is inserted into the limiting groove 411 to be positioned therein. The upper inclined portion 311 and the lower inclined portion 321 of the lock tongue 3 are moved outward along the upper wall 531 and the lower wall 532 of the inclined groove 53, so that the upper lock plate 31 and the lower lock plate 32 are rotated towards each other by the torsion spring 10 until the front end of the upper lock plate 31 and the front end of the lower lock plate 32 are closed. Therefore, the front end of the closed lock tongue 3 can be pulled out from the lock hole of the computer to realize unlocking.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A square computer lock, comprising a square housing, and a lock core, a lock tongue, an unlocking button, a locking button and a latch arranged in the square housing;

a front side of the square housing being formed with a hole, the lock tongue being composed of an upper lock plate and a lower lock plate, the upper lock plate and the lower lock plate being symmetrical and arranged one on top of another, a middle portion of the upper lock plate and a middle portion of the lower lock plate being pivotally connected to the hole through fixing pins respectively, front ends of the upper lock plate and the lower lock plate extending out of the hole, a rear end of the upper lock plate being inclined upward to form an upper inclined portion, a rear end of the lower lock plate being inclined downward to form a lower inclined portion, a rotation space being defined between the upper inclined portion and the lower inclined portion, a torsion spring being provided in the rotation space;

a rear side of the square housing being formed with an insertion hole allowing a key to be inserted and corresponding in position to a lock core lock hole, a row of plate tumblers being arranged in the lock core lock hole, a plate tumbler spring being arranged below each of the plate tumblers, the plate tumblers cooperating with key bits of the key inserted into the lock core lock hole when unlocked and being pushed down by the key bits to press down the plate tumbler springs, the plate tumblers being moved upward and returned by the plate tumbler springs when locked, one side of each plate tumbler being formed with a positioning groove, one side of the lock core being formed with an engaging groove, a bottom of the engaging groove being provided with a row of positioning holes corresponding to the positioning grooves of the plate tumblers, the positioning grooves being aligned with the positioning holes when the plate tumblers are pushed down by the key; the latch being disposed in the engaging groove, one side of the latch being provided with a row of positioning posts corresponding in position to the positioning holes, each of the positioning posts being sleeved with a latch spring, one end of the latch spring abutting against a periphery of a corresponding one of the positioning holes; a top of the square housing being formed with an unlocking hole and a locking hole, an upper end of the unlocking button being movably inserted through the unlocking hole to be moved up and down, a lower end of the unlocking button being formed with a wedge-shaped plate corresponding to the latch, an unlocking spring being arranged between the wedge-shaped plate and a bottom of the square housing, a front side of the wedge-shaped plate being formed with a limiting groove; the locking button being movably disposed in the square housing to be moved frontward and backward, an upper end of the locking button being inserted through the locking hole to be moved frontward and backward, a rear side of the locking button being formed with a limiting plate corresponding to the limiting groove, a front side of the locking button being formed with an inclined groove corresponding to the upper inclined portion and the lower inclined portion, the inclined groove having an inclined upper wall and an inclined lower wall, an upper edge of the upper inclined portion and a lower edge of the lower inclined portion abutting against the upper wall and the lower wall respectively, a locking spring being provided between the front side of the locking button and the square housing;

wherein the unlocking button is moved downward by an external force to compress the unlocking spring when unlocking, and the wedge-shaped plate pushes the latch into the engaging groove, so that the positioning posts of the latch are inserted into the positioning holes and the positioning grooves, the limiting groove is aligned with the limiting plate of the locking button, the locking button is moved backward by the locking spring so that the limiting plate is inserted into the limiting groove to be positioned therein, the upper inclined portion and the lower inclined portion of the lock tongue are moved outward along the upper wall and the lower wall of the inclined groove, so that the upper lock plate and the lower lock plate are rotated towards each other by the torsion spring until the front end of the upper lock plate and the front end of the lower lock plate are closed;

wherein the upper end of the locking button is pushed forward by an external force when locking, so that the limiting plate is disengaged from the limiting groove and presses against the front side of the wedge-shaped plate to release the positioning of the unlocking button and compress the locking spring, the unlocking button is moved upward and returned by the unlocking spring, the latch is moved outward and returned from the positioning grooves and the positioning holes by the latch springs on the positioning posts, after the key is pulled out, the plate tumblers are moved upward and returned by the plate tumbler springs, the upper inclined portion and the lower inclined portion of the lock tongue are moved into the inclined groove along the upper wall and the lower wall respectively, so that the upper lock plate and the lower lock plate are pushed by the upper wall and the lower wall to rotate reversely, and the front end of the upper lock plate and the front end of the lower lock plate are separated by a predetermined distance.

2. The square computer lock as claimed in claim 1, further comprising a cable and a cable connector, the cable connector including a first connector and a second connector, a front end of the first connector being formed with a notch, the bottom of the square housing being formed with a connecting hole, a bottom of the lock core being formed with a connecting plate, the connecting plate being inserted into the notch after passing through the connecting hole and pivotally connected to the first connector by means of a rotation of 180° through a pivot; the second connector being connected to the first connector by means of a rotation of 360°, the cable being connected to the second connector.

3. The square computer lock as claimed in claim 1, wherein the square housing is composed of a seat and a cover plate, the cover plate covers one side of the seat, the hole is formed on a front side of the seat, the unlocking hole and the locking hole are formed on a top of the seat, and the insertion hole is formed on a rear side of the seat.

4. The square computer lock as claimed in claim 1, wherein the upper end of the unlocking button is formed with a cylindrical press portion, the upper end of the locking button is formed with a push portion, and the push portion has a curved push surface on which anti-skid ribs are formed.

5. The square computer lock as claimed in claim 1, wherein a rubber pad is attached to the front side of the locking button, and the rubber pad has a through hole corresponding to the inclined groove.

6. The square computer lock as claimed in claim 1, wherein the limiting groove is a square groove.

7. The square computer lock as claimed in claim 1, wherein the lock core is fixedly installed in the square housing through the fixing pins.

* * * * *